US009065183B2

(12) United States Patent
Suzuki

(10) Patent No.: US 9,065,183 B2
(45) Date of Patent: Jun. 23, 2015

(54) LEAKY COAXIAL CABLE

(75) Inventor: Fumio Suzuki, Sakura (JP)

(73) Assignee: FUJIKURA LTD., Tokyo (JP)

( * ) Notice: Subject to any disclaimer, the term of this patent is extended or adjusted under 35 U.S.C. 154(b) by 53 days.

(21) Appl. No.: 13/572,019

(22) Filed: Aug. 10, 2012

(65) Prior Publication Data

US 2012/0298397 A1 Nov. 29, 2012

Related U.S. Application Data

(63) Continuation of application No. PCT/JP2011/052560, filed on Feb. 7, 2011.

(30) Foreign Application Priority Data

Feb. 12, 2010 (JP) ..... 2010-029563

(51) Int. Cl.
*H01B 7/17* (2006.01)
*H01Q 13/20* (2006.01)

(52) U.S. Cl.
CPC ..... *H01Q 13/203* (2013.01)

(58) Field of Classification Search
CPC ..... H01B 1/1878; H01B 11/1878; H01B 13/202; H01B 13/204; H01B 13/206; H01B 13/208; H01Q 13/203; H01Q 13/20; H04B 5/0018
USPC ..... 174/102 R, 105 R, 105 B, 103, 108, 174/102 S, 102 SP, 109; 333/237
See application file for complete search history.

(56) References Cited

U.S. PATENT DOCUMENTS

| | | | | |
|---|---|---|---|---|
| 6,064,000 | A * | 5/2000 | Kim | 174/36 |
| 6,472,603 | B1 | 10/2002 | Inoue | |
| 7,075,010 | B2 * | 7/2006 | Santelli, Jr. | 174/72 R |
| 7,235,737 | B2 | 6/2007 | Rodrigues et al. | |
| 2005/0787358 | | 4/2005 | Santelli, Jr. | |

FOREIGN PATENT DOCUMENTS

| | | | |
|---|---|---|---|
| CA | 959139 | A1 | 12/1974 |
| CA | 1209657 | A | 8/1986 |

(Continued)

OTHER PUBLICATIONS

Office Action issued by the Japanese Patent Office in Japanese Application No. 2011-553833 dated Oct. 30, 2012.

(Continued)

*Primary Examiner* — Hoa C Nguyen
*Assistant Examiner* — Amol Patel
(74) *Attorney, Agent, or Firm* — Sughrue Mion, PLLC

(57) ABSTRACT

A leaky coaxial cable includes: a central conductor; an insulator configured to cover the central conductor; an external conductor wound around the insulator, having a thickness of 5 μm to 44 μm, and including multiple slots formed periodically in a longitudinal direction of the cable; a plastic film attached to the external conductor, and having a thickness of 5 μm to 36 μm; and an outer sheath configured to cover the external conductor and the plastic film, as well as characterized in that the plastic film is attached to a surface of the external conductor facing the outer sheath.

13 Claims, 8 Drawing Sheets

(56) References Cited

FOREIGN PATENT DOCUMENTS

| | | | | |
|---|---|---|---|---|
| CN | 1290123 | C | | 12/2006 |
| CN | 101140817 | A | * | 3/2008 |
| EP | 1606865 | B1 | | 5/2007 |
| GB | 1323596 | A | | 7/1973 |
| JP | 10-193001 | A | | 7/1998 |
| JP | 2000-188020 | A | | 7/2000 |
| JP | 2002-352639 | A | | 12/2002 |
| JP | 2002-367448 | A | | 12/2002 |
| JP | 2002367448 | A | * | 12/2002 |
| JP | 2003-179415 | A | | 6/2003 |
| JP | 2005-050981 | A | | 2/2005 |
| WO | 9957735 | A1 | | 11/1999 |

OTHER PUBLICATIONS

Kishimoto, T., et al., "LCX Tsuushin Sisutemu (LCX Communications System), 1st ed.," Korona Publishing Co., Ltd., Tokyo, Japan, Aug. 1982, ISBN:978-.4-885-52040-2.

Office Action issued by Chinese Patent Office in Chinese Application No. 2011800090055.3 mailed Dec. 3, 2013.

Chinese Office Action for corresponding Application No. 201180009055.3 issued Jul. 28, 2014.

Communication dated Feb. 9, 2015 from the State Intellectual Property Office of the People's Republic of China in counterpart application No. 201180009055.3.

* cited by examiner

LEAKY COAXIAL CABLE

CROSS-REFERENCE

This application is a Continuation of PCT Application No. PCT/JP2011/052560, filed on Feb. 7, 2011, and claims the priority of Japanese Patent Application No. 2010-029563, filed on Feb. 12, 2010, the content of both of which is incorporated herein by reference.

BACKGROUND OF THE INVENTION

1. Field of the Invention

The present invention relates to a leaky coaxial cable in which the outer diameter of an insulator is below 10 mm.

2. Description of the Related Art

As described in Kishimoto, T. and Sasaki, S., 1982, *LCX Tsuushin Sisutemu* (*LCX Communications System*), 1st ed., Corona Publishing Co., Ltd., Tokyo, Japan, a leaky coaxial cable (LCX) is a cable which is designed to radiate part of electric signal energy to be transmitted inside the cable to the outside in the form of electromagnetic waves. The LCX is used as a transmission and reception antenna in a radio communication system. The LCX is installed along railroad tracks for radio communications between trains and the ground, for example. The LCX is also installed in subway stations or underground malls for fire radio communications or police radio communications to and from the subway stations or the underground malls.

A conventional LCX is shown in FIG. 1. As shown in the drawing, the LCX is formed as a coaxial cable which includes: a central conductor 201; an insulator 202 covering the central conductor 201; an external conductor 203 located around this insulator 202; and an outer sheath 205 covering this external conductor 203. The material of the central conductor 201 and the external conductor 203 is usually copper, and aluminum is sometimes used as well. The material of the insulator 202 is Polyethylene, for example.

The external conductor 203 of the LCX has slots 206 serving as electromagnetic wave leak mechanisms. The slots 206 are provided periodically in the longitudinal direction of the cable. Each slot is an opening having an elongated shape or a round shape.

A type name of the LCX is generally expressed by using an outer diameter of the insulator and the characteristic impedance (standard impedance) of the LCX. For example, if the LCX includes the insulator with an outer diameter of 20 mm and has impedance of 50Ω, then the LCX is expressed as 20D type. The LCX conventionally includes 20D type, 33D type, 43D type and so forth, and the outer diameters of the outer sheaths thereof are as extremely large as 30 mm, 40 mm, and 50 mm, respectively. In the meantime, the external conductor needs to be thick enough not to stretch or crack even when traction force or bending force is applied thereto at the time of outdoor installation. To be more specific, this thickness is approximately from 0.1 mm to 0.2 mm in consideration of material costs as well.

Japanese Patent Application Laid-Open Publication Nos. 10-193001 and 2003-179415 describe methods of forming the slots 206 in the external conductor 203. The former discloses press work using male and female dies formed in conformity to the shape of the slots 206, and the latter discloses formation by means of laser beam irradiation. As another formation method, cutting work using an end mill is proposed.

SUMMARY OF THE INVENTION

As described above, the conventional LCX is supposed to be mainly installed outdoors, and it is taken into account that high tensile force is applied to the LCX at the time of its installation. Accordingly, the outer diameter of the insulator 202 is as large as 20 mm or more, while the thickness of the external conductor 203 is as large as about 0.1 mm to 0.2 mm. Nevertheless, the LCX has more often been used indoors in recent years, and there is an increasing need for the LCX with smaller diameters.

However, when the diameter of the LCX is reduced and bended, for example when the outer diameter of the insulator 202 is reduced to below 10 mm and it is bended, it may be difficult to keep the external conductor 203 in intimate contact with the insulator 202. This is because of high rigidity and strong resilience of the external conductor 203, thus the external conductor 203 comes to recoil, for example. Meanwhile, if frictional force between the external conductor 203 and the insulator 202 is weak, tensile force and bending force are applied to the LCX in the course of installation work. Moreover, when these forces are released, the stretched external conductor 203 is plastically deformed because of being made of metal, thus the insulator 202 shrinks. For this reason, the insulator 202 moves inside the external conductor 203, and a following serious accident may accordingly occur: disconnection of the central conductor 201 or discontinuation of communications due to detachment of the central conductor 201 and the insulator 202 at a connector portion.

When frictional force between the external conductor 203 and the outer sheath 205 that covers this external conductor 203 is weak, tensile force and bending force are applied to the LCX. Moreover, when these forces are released, the stretched external conductor 203 is plastically deformed because of being made of metal, whereas the outer sheath 205 shrinks. For this reason, the outer sheath 205 moves relative to the external conductor 203. In this case, the outer sheath 205 comes off the connector portion, and the connector is loosened as a consequence. In the worst case, the connector may fall out, and a serious accident may accordingly occur, such as disconnection of communications due to breakage of the external conductor 203, the insulator 202, and the central conductor 201.

When the external conductor 203 is thinned for reducing the diameter of the LCX, a plastic film (a plastic plate) 204 needs to be attached to the external conductor 203 as shown in FIG. 1 in order to retain the strength of the external conductor 203. In this case, the external conductor 203 is wound around the insulator 202 in such a manner as to form an overlapping portion of the external conductor 203 as shown in FIG. 1 to prevent unwanted leakage of electromagnetic wave energy from the LCX. However, this overlapping portion cannot establish electrical contact due to the presence of the plastic film 204, and a gap equivalent to the thickness of the plastic film 204 occurs between the external conductor 203 and the insulator. As a result, there is a problem of slight leakage of the electromagnetic wave energy from this gap.

When the slots 206 are formed in the external conductor 203 by the press work in the course of production of the LCX, there are a problem of a high manufacturing cost attributable to expensive dies, and a problem of its short operating life. On the other hand, when the slots 206 are formed by the cutting work, there are a problem of a long machining time, and a problem of its short operating life. As described above, it is complicated to manufacture the external conductor 203 provided with the slots 206, and the manufacturing costs tend to rise as well. Accordingly, there is a demand for an easier and less expensive manufacturing method.

The present invention has been made in view of the aforementioned circumstances, and an object thereof is to provide a leaky coaxial cable, which is capable of preventing the movement of an insulator inside an external conductor or the movement of an outer sheath on the external conductor despite a reduction in a diameter, capable of preventing unwanted leakage of electromagnetic wave energy, and capable of being manufactured easily and at low costs.

A first aspect of the present invention is a leaky coaxial cable comprising: a central conductor; an insulator covering the central conductor; an external conductor wound around the insulator, having a thickness of 5 μm to 44 μm, and including a plurality of slots formed periodically in a longitudinal direction of the cable; a plastic film attached to the external conductor and having a thickness of 5 μm to 36 μm; and an outer sheath covering the external conductor and the plastic film, wherein the plastic film is attached to a surface of the external conductor facing the outer sheath.

The plastic film may be attached to the external conductor by use of a first adhesive having viscosity and adhesiveness.

The plastic cover may be attached to the outer sheath by use of a second adhesive.

The external conductor may has a width that forms an overlapping portion in which ends of the external conductor overlap each other when the external conductor is wound around the insulator. The width of the external conductor may be longer by 2 mm to 10 mm than an outer peripheral length of the insulator. The end of the external conductor in the overlapping portion, which is located closer to the insulator, may be bent outward.

The width of the external conductor may be longer by 2 mm to 10 mm than a width of the plastic film. The end of the external conductor in the overlapping portion, which is located closer to the insulator, may protrude from the plastic film.

The slots may be formed at the same time by an etching method.

The present invention makes it possible to provide a leaky coaxial cable, which is capable of preventing the movement of an insulator inside an external conductor or the movement of an outer sheath on the external conductor despite a reduction in a diameter, capable of preventing unwanted leakage of electromagnetic wave energy, and capable of being manufactured easily and at low costs.

DESCRIPTION OF THE PREFERRED EMBODIMENTS

Figure 1:
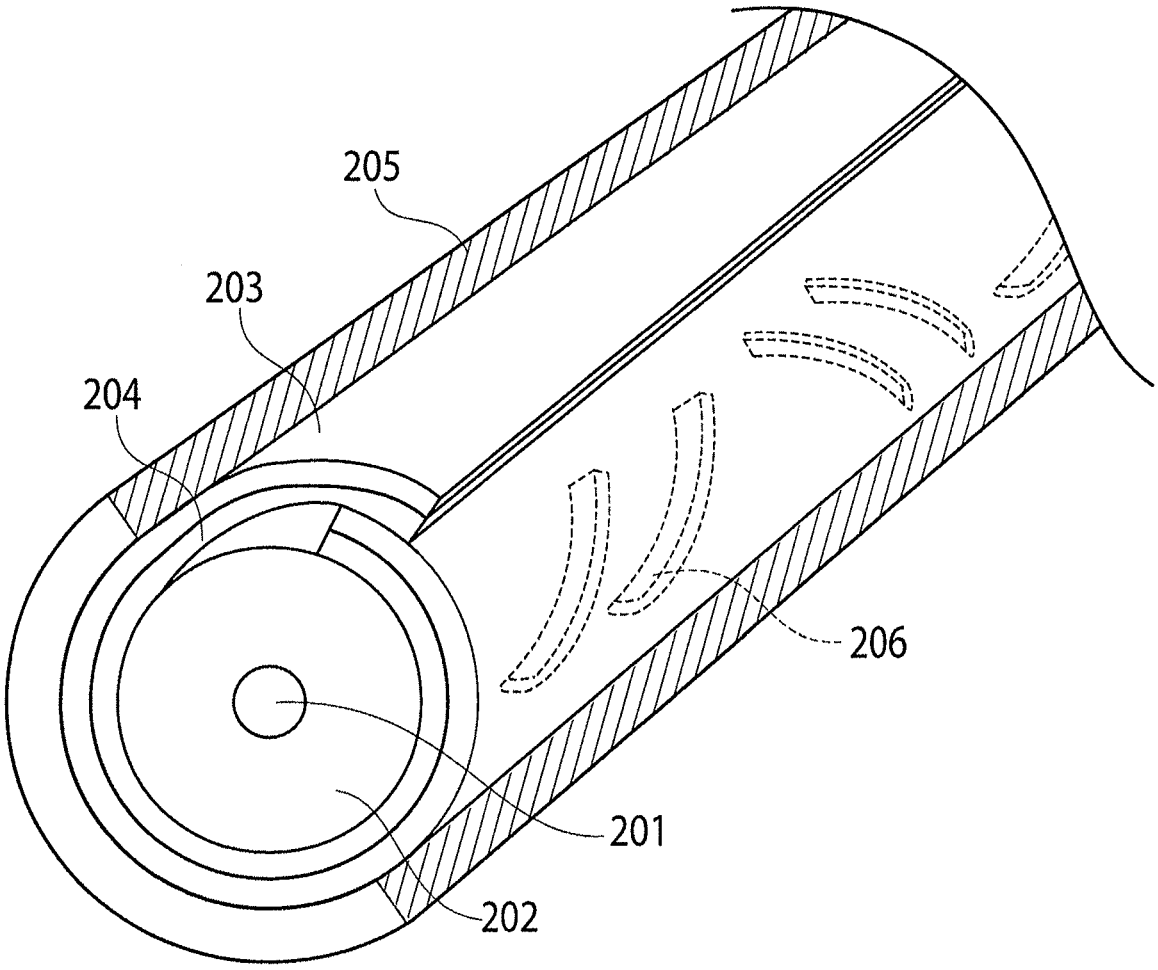
FIG. 1 is a cross-sectional view showing a configuration of a conventional leaky coaxial cable.

Embodiments of the present invention will be described below in detail by referring to the drawings.

First Embodiment

Figure 2:
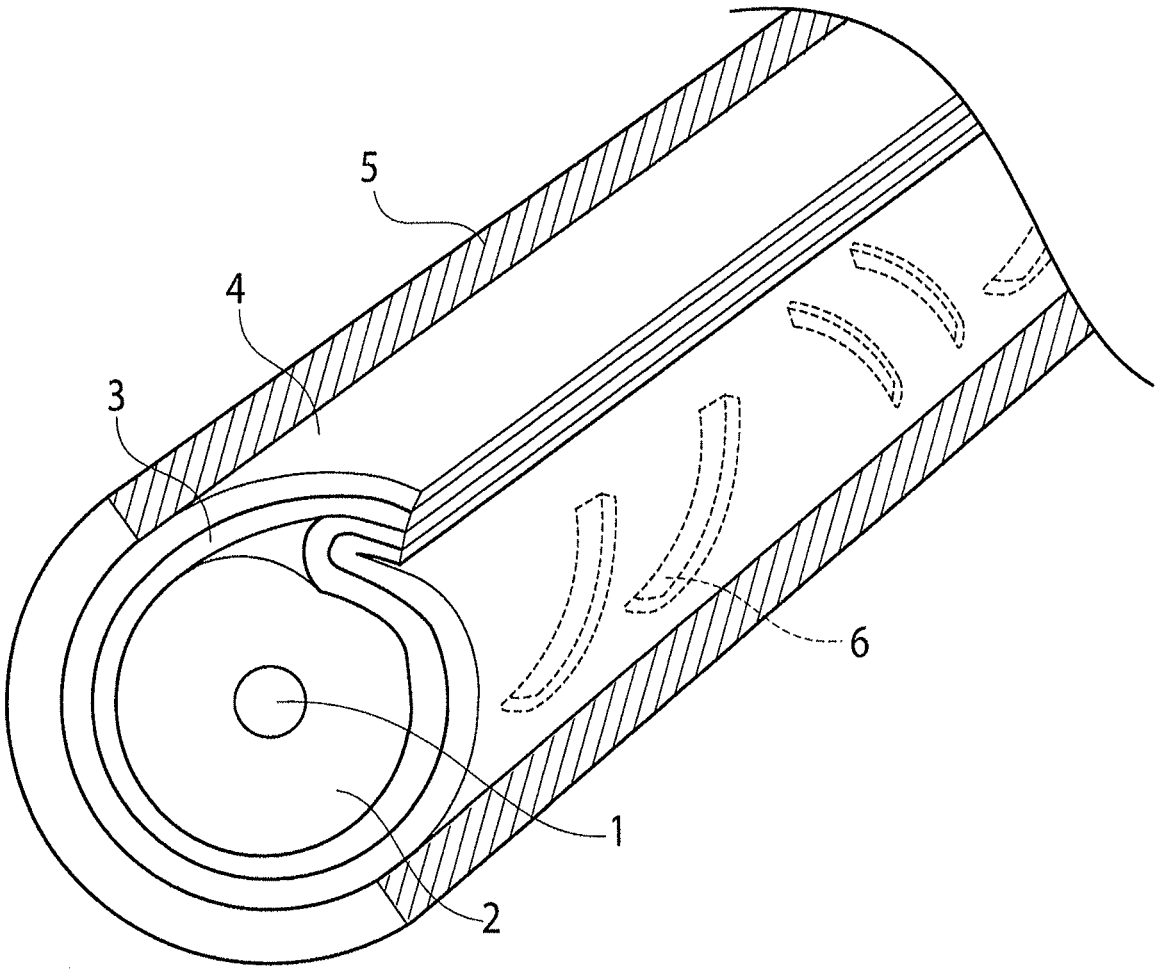
FIG. 2 is a cross-sectional view showing a configuration of a leaky coaxial cable of a first embodiment of the present invention.

FIG. 2 is a cross-sectional view showing a configuration of a leaky coaxial cable (LCX) of a first embodiment of the present invention.

The leaky coaxial cable of the present embodiment includes a central conductor 1, an insulator 2 covering the central conductor 1, and a substantially cylindrical external conductor 3 wound around the insulator 2. In the present embodiment, the external conductor 3 is longitudinally wrapped around the insulator 2. The longitudinal wrapping means wrapping in such a manner that two edges parallel to a longitudinal direction of an object overlap each other (or butt each other) (see FIG. 3) when the object is tape-shaped and is wound around an elongated cylindrical body such as a cable, for example.

The central conductor 1 is a metal wire. The central conductor 1 is a copper wire or an aluminum wire, for example. The insulator 2 is made of a synthetic resin material such as polyethylene or the like. An outer diameter of the insulator 2 is 10 mm or less, for example. The external conductor 3 is a tape-shaped metal film made of copper, aluminum or the like, and has a thickness of 5 μm to 44 μm. In a surface of the external conductor 3, multiple slots (elongated openings) 6 are formed periodically in a longitudinal direction of the cable. The multiple slots 6 functions as electromagnetic wave leak mechanisms. This leaky coaxial cable radiates part of electric signal energy transmitted in the inside from the multiple slots 206 to the outside as electromagnetic waves.

An etching method is used for forming the slots 6 of the present embodiment. Numerous slots can be formed at the same time by etching the metal tape that serves as the external conductor 3. Thus, the external conductor 3 provided with the multiple slots 6 can be manufactured easily and at low costs.

In the conventional leaky coaxial cables, the external conductor has a large thickness of 0.1 mm to 0.2 mm. Meanwhile, in the 20D-type LCX, the 33D-type LCX, and the 43° D.-type LCX, the widths of their external conductors before wound around the insulators are as large as about 80 mm, 120 mm, and 150 mm, respectively. When the slots are formed in these external conductors, therefore, the external conductors before wound around the insulators are pressed individually by using male and female dies.

However, in the leaky coaxial cable of the present embodiment, the external conductor 3 has the thickness of 5 μm to 44 μm. In addition, the width of the external conductor 3 before wound around the insulator 2 is about equal to 18 mm in a 5D-type LCX, or about 10 mm in a 2.5D-type LCX, which in either case is much narrower than the widths of the external conductors used in the conventional leaky coaxial cables. An etching technique, therefore, can be applicable to the formation of the slots 6. Numerous external conductors 3 can be manufactured at the same time, and cost reduction can be achieved, by use of a wide metal sheet (a metal plate) designed to be divided later into multiple external conductors 3.

When the external conductors 3 for the 2.5D-type LCX are manufactured by use of a metal sheet having a width of 500 mm, for example, fifty external conductors 3 can be formed all at once by a single etching operation because each external conductor 3 has the width of 10 mm. In this way, the dies that have been used to form the conventional external conductors with the requirement of regular replacement are no longer essential, and the manufacturing costs can be reduced to about one-tenth.

A plastic film (a plastic plate) 4 is attached to the external conductor 3 of the present embodiment. The plastic film 4 has a thickness of 5 μm to 36 μm. Further, the external conductor 3 and the plastic film 4 are covered with an outer sheath 5. The outer sheath 5 is made of a synthetic resin material. The plastic film 4 is attached to a surface of the external conductor 3 facing the outer sheath 5.

This plastic film 4 reinforces the thin external conductor 3 having the aforementioned thickness. Thus, the external conductor 3 can be easily wound (longitudinally wrapped) around the insulator 2 even when the diameter of this insulator 2 is reduced.

Figure 3:
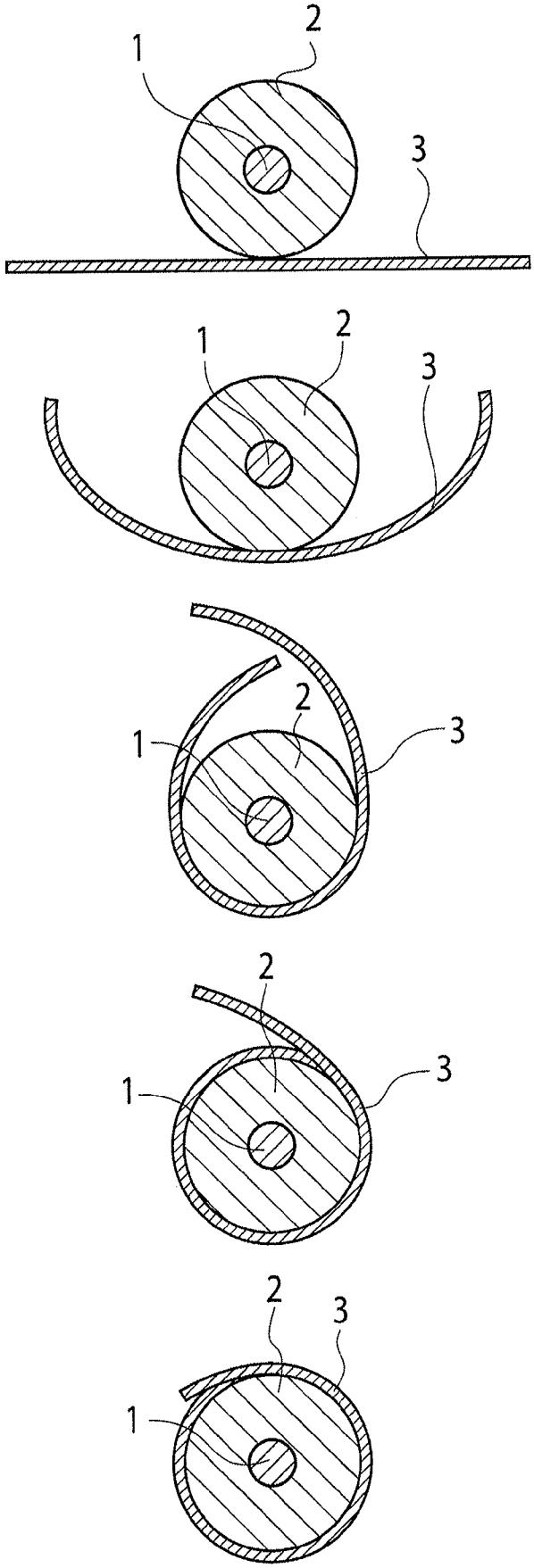
FIG. 3 is a cross-sectional view showing a manufacturing process of the leaky coaxial cable of the first embodiment of the present invention.

FIG. 3 is a cross-sectional view showing a manufacturing process of the leaky coaxial cable of the first embodiment of the present invention.

The external conductor 3 is wound around the insulator 2 as shown in FIGS. 3(*a*) to 3(*e*) by means of rolling using a group of multiple rolls (not shown) or a horn-shaped plate (not shown), for example.

As described previously, the thickness of the external conductor of the conventional leaky coaxial cable is from about 0.1 mm to 0.2 mm. Although an attempt to wind an external conductor made of copper with the thickness of 0.1 mm was carried out, it was difficult to wind the external conductor around the outer periphery of the insulator without causing a gap therebetween because of the high rigidity of the external conductor. The outer diameter of the insulator that allowed the winding of the external conductor having the thickness of 0.1 mm without causing a gap turns out to be 10 mm or more. As a result of further trials, when the outer diameter of the insulator was equal to 9 mm, the external conductor made of copper was able to be wound without causing a gap when the external conductor has the thickness of about 0.08 mm.

As described above, the smaller thickness of the external conductor is more desirable in light of the formability. Nevertheless, signal currents concentrate on a surface and its neighborhood due to the skin effect in the case of transmitting radio-frequency signals. It is therefore necessary to provide an adequate thickness by considering the skin depth. It is generally said that the thickness with the skin effect taken in consideration can be accomplished by use of a metal plate having about 5 times as thick as the skin depth.

Table 1 shows results of calculating the skin depth relative to the frequency and the thickness multiplied by 5 in the case of copper and aluminum. The depth and thickness values are expressed in micrometers, and each value in parentheses indicates a quintuple of the corresponding skin depth. A frequency range from 0.1 GHz to 10 GHz is focused. This frequency range includes frequencies for which the LCX are generally used.

As shown in Table 1, the thickness required in terms of copper and aluminum ranges from 33 μm to 44 μm at the frequency of 0.1 GHz, or from 3.3 μm to 4.4 μm at the frequency of 10 GHz.

TABLE 1

Skin Depth of Copper and Aluminum (μm)

| | Frequency (GHz) | | | |
|---|---|---|---|---|
| Metal type | 0.1 | 0.5 | 1.0 | 10 |
| Copper | 6.6 (33) | 3.0 (15) | 2.1 (11) | 0.66 (3.3) |
| Aluminum | 8.7 (44) | 3.9 (20) | 2.8 (14) | 0.87 (4.4) |

Note:
Value in Parentheses represents Quintuple of Skin Depth.

Accordingly, in the case of copper or aluminum used in general coaxial cables at the typically used frequency band, it is learned that the thickness of the external conductor 3 needs to be set in the range from 5 μm into 44 μm. It should be noted that, if the external conductor 3 becomes thinner, it is preferable to attach the plastic film 4 made of PET or the like in order to increase the strength. From the results of the trials described above, a total thickness of the external conductor 3 and the plastic film 4 is preferably equal to or below 0.08 mm. The thickness of the plastic film 4, therefore, is preferably set in the range from 5 μm to 36 μm.

Figure 4:
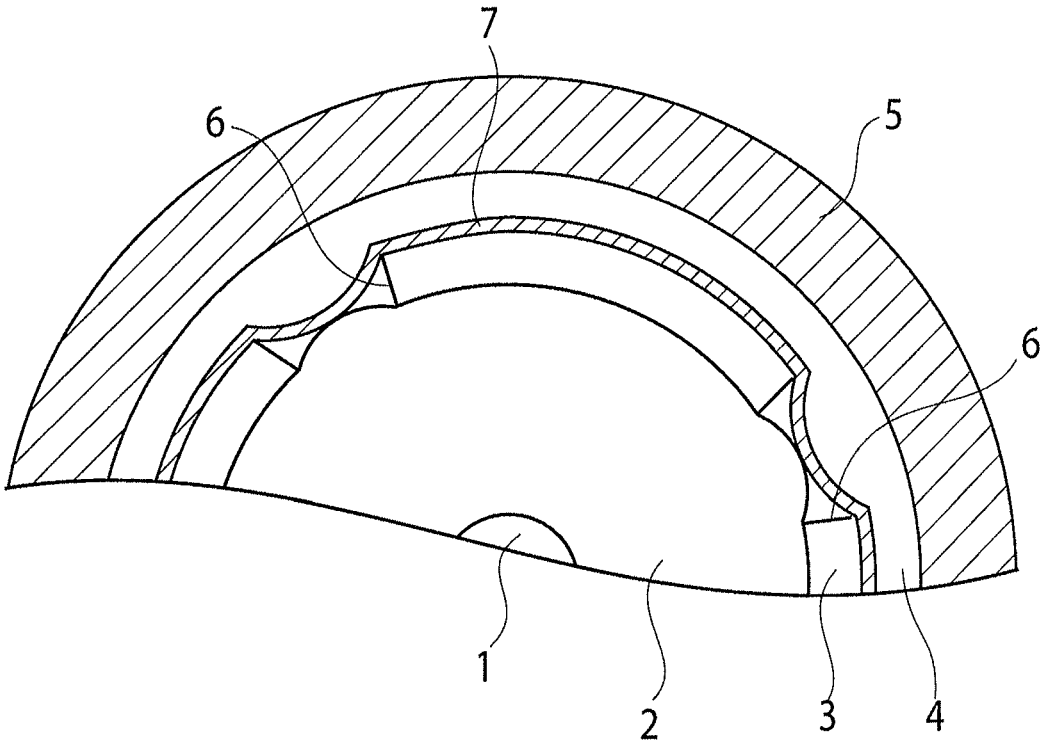
FIG. 4 is a cross-sectional view showing a configuration of a substantial part of the leaky coaxial cable of the first embodiment of the present invention.

FIG. 4 is a cross-sectional view showing a configuration of a substantial part of the leaky coaxial cable of the first embodiment of the present invention.

The plastic film 4 is attached to the surface of the external conductor 3 facing the outer sheath 5. The slots 6 in the external conductor 3 and the insulator 2 are directly contacted to each other, whereby edge portions of the slots 6 bite a surface of the insulator 2. Thus, the adhesion between the external conductor 3 and the insulator 2 is enhanced. Accordingly, the insulator 2 is prevented from moving inside the external conductor 3 even when the leaky coaxial cable undergoes expansion and contraction, or bending and stretching. Meanwhile, since the slots 6 are the openings formed by partially removing the external conductor 3, the adhesion between the external conductor 3 and the insulator 2 is improved by the edges of the openings biting the surface of the insulator 2.

Here, measurement of the adhesion force generated between the external conductor 3 and the insulator 2 of the embodiment will be described. In this measurement, samples were used as the leaky coaxial cable of the present embodiment. Here, the samples has the following structures: the external conductor 3 is made of a 10-micrometer-thick copper film; the plastic film 4 is made of a 10-micrometer-thick PET film; these external conductor 3 and plastic film 4 were beforehand attached together, and are wound around the insulator 2 having an outer diameter of 2.5 mm. The entire length of each sample was set at 30 mm. Each of the slots 6 formed in the external conductor 3 had a length of 10 mm and a width of 2 mm. The slot 6 inclined to the longitudinal direction of the external conductor 3 (or the longitudinal direction of the cable) by 20°. In other words, the angle defined between the longitudinal direction of the external conductor 3 and the extending direction of the slot 6 was equal to 20°. The outer sheath 5 was formed as an outermost layer around the external conductor 3 (or the plastic film 4).

Aforementioned samples are classified into a sample A and sample B. The sample A is formed by attaching the plastic film 4 to the surface of the external conductor 3 facing the outer sheath 5. Alternatively, the sample B is formed by attaching the plastic film 4 to a surface of the external conductor 3 facing the insulator 2. These samples A, B were compared in terms of the adhesion force generated between the external conductor 3 and the insulator 2.

Figure 6:
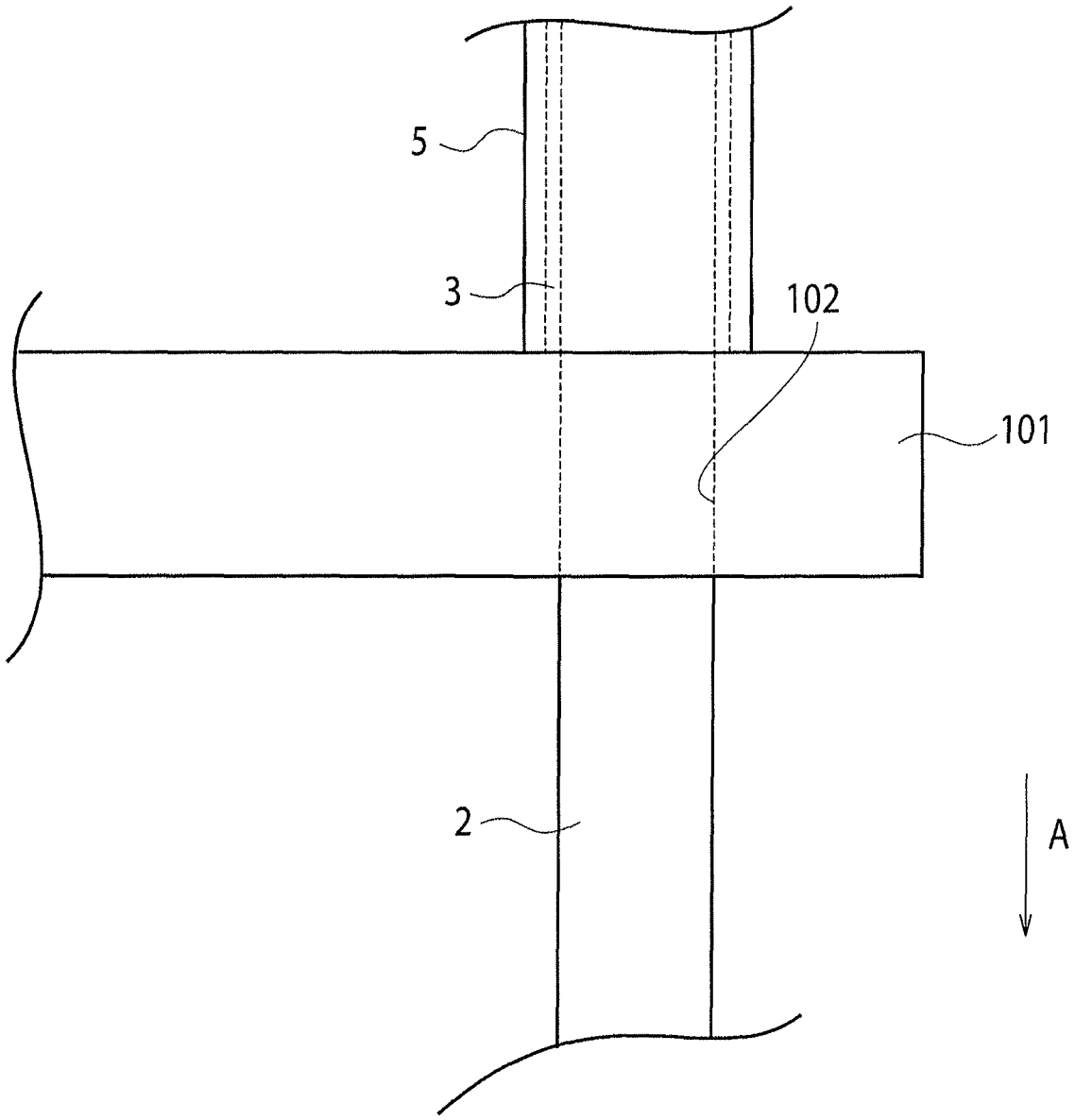
FIG. 6 is a plan view showing a method of measuring the adhesion between an external conductor and an insulator.

FIG. 6 is a plan view showing a method of measuring the adhesion force between the external conductor and the insulator.

A measuring jig 101 shown in FIG. 6 was used for this measurement. The measuring jig 101 was a square bar having a rectangular cross section, for example. It has a hole 102 which penetrates between mutually parallel side surfaces thereof. The adhesion force was evaluated by: inserting each of the samples A, B into the hole 102 in a direction indicated with an arrow A in FIG. 6; and measuring force required for causing the sample to pass therethrough. The inner diameter of the hole 102 was equal to the outer diameter of the insulator 2. Accordingly, the external conductor 3 and the outer sheath 5 of the leaky coaxial cable (the sample A or B) were peeled off when the cable passed through the hole 102. As a result of conducting the measurement as described above, the sample A showed a value of 1.8 kgf, and the sample B showed a value of 1.5 kgf. That is, the adhesion of the sample A formed by attaching the plastic film 4 to the surface of the external conductor 3 facing the outer sheath 5 was stronger than that of the sample B formed by attaching the plastic film 4 to the surface of the external conductor 3 facing the insulator 2. This is conceivably due to the fact that in the sample A, the edges of the slots 6 bit the insulator 2 because the plastic film 4 was located between the external conductor 3 and the outer sheath 5.

Here, the plastic film 4 was attached to the external conductor 3 with an adhesive (a first adhesive) 7 having glutinosity (i.e., viscosity and adhesiveness). Accordingly, when the plastic film 4 was attached to the surface of the external conductor 3 facing the outer sheath 5, the plastic film 4 directly stuck to the insulator 2 by means of the adhesive 7 through the slots 6 in the external conductor 3, thereby enhancing the adhesion between the external conductor 3 and the insulator 2. Accordingly, the movement of the insulator 2 inside the external conductor 3 was avoided even when the leaky coaxial cable undergoes expansion and contraction, or bending and stretching.

As the other sample of the above-described leaky coaxial cable, a sample C was prepared. The sample C has the following structures: the external conductor 3 is formed of a 10-micrometer-thick copper film: the plastic film 4 is formed of a 10-micrometer-thick PET film; these external conductor 3 and plastic film 4 were beforehand attached together by use of the adhesive 7 being a two-micrometer-thick acrylic-based adhesive material, and wound around the insulator 2 having an outer diameter of 2.5 mm. Here, the plastic film 4 was attached to the surface of the external conductor 3 facing the outer sheath 5, as shown in FIG. 4. Meanwhile, the length of the sample C was set at 30 mm as in the case of the above-described samples A and B. In the meantime, each slot 6 had the length of 10 mm and the width of 2 mm, and the extending direction thereof inclined the longitudinal direction of the external conductor 3 by 20°.

The adhesion force between the external conductor 3 and the insulator 2 of this sample C was measured by use of the above-described measuring jig 101. The result shows a value of 2.0 kgf. Thus, the adhesion between the external conductor 3 and the insulator 2 turns out to be enhanced by the adhesive material.

Figure 5:
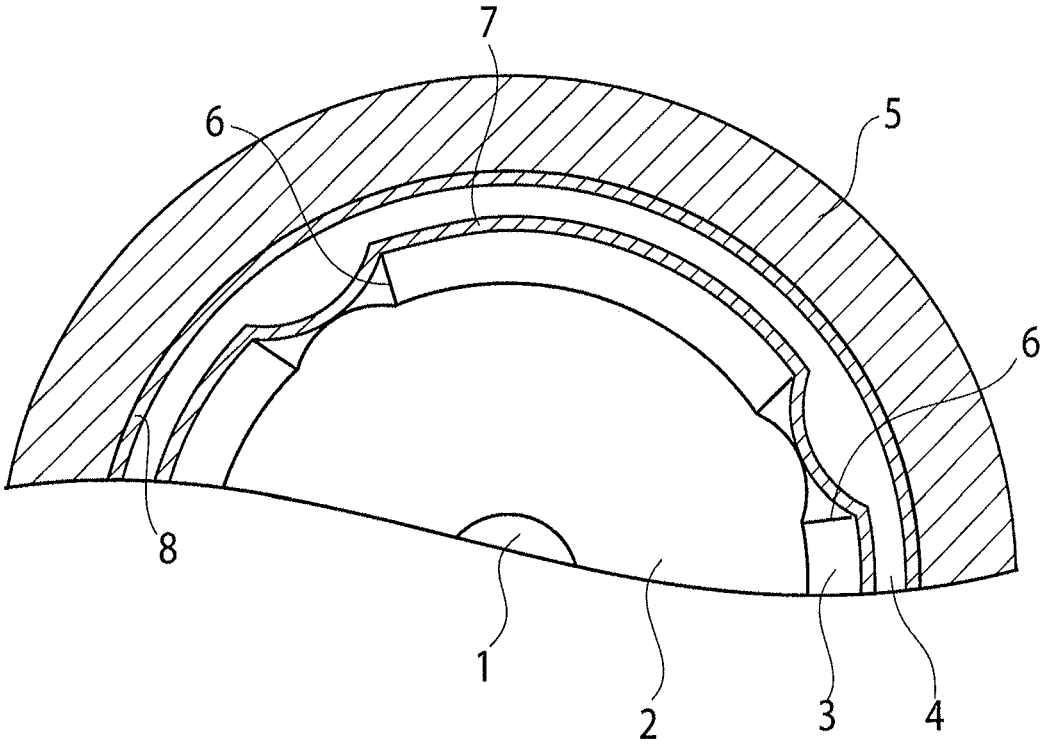
FIG. 5 is a cross-sectional view showing another configuration of the substantial part of the leaky coaxial cable of the first embodiment of the present invention.

Moreover, as shown in FIG. 5, an adhesive (a second adhesive) 8 for attaching the plastic film 4 to the outer sheath 5 may be provided on the surface of the plastic film 4 facing the outer sheath 5. In this case, the adhesion between the external conductor 3 and the outer sheath 5 is enhanced, and the movement of the outer sheath 5 on the external conductor 3 is avoided even when the cable undergoes expansion and contraction, or bending and stretching.

The adhesive 8 is an EVA (ethylene vinyl acetate)-based adhesive, for example. The plastic film 4 is formed of a PET film, and the adhesive 8 is coated thereon in advance. The leaky coaxial cable is formed by: attaching this plastic film 4 to the external conductor 3; winding the external conductor 3 with the plastic film 4 around the insulator 2; and then providing the outer sheath 5 made of polyethylene. In this case, the outer sheath 5 adheres to the plastic film 4 via the adhesive 8 by heat of fusion of polyethylene constituting the outer sheath 5. As a consequence, the external conductor 3 and the outer sheath 5 firmly adhere together, and the movement of the external conductor 3 inside the outer sheath 5 is avoided.

As shown in FIG. 2, the width of the external conductor 3 (i.e., its length in the perpendicular direction to the longitudinal direction before being wound around the insulator 2) is longer by 2 mm to 10 mm than the outer peripheral length of the insulator 2. Accordingly, the external conductor 3 forms an overlapping portion per se when the external conductor 3 is would around the insulator 2. Of this overlapping portion, an end of the external conductor 3 located close to the insulator 2 is bent outward, whereby electricity is allowed to pass between two ends of the external conductor 3.

As a consequence, unwanted leakage of electromagnetic waves from the overlapping portion of the external conductor 3 is prevented, and the original state of electromagnetic wave radiation is not disturbed. Moreover, it is possible to suppress attenuation which would otherwise be attributable to the unwanted leakage of electromagnetic waves.

In the conventional leaky coaxial cable, the plastic film is interposed between the ends at the overlapping portion of the external conductor. The ends at the overlapping portion of the external conductor, therefore, do not come into physical contact with each other, and are in an electrically insulated state. In this case, unwanted leakage of electromagnetic waves occurs in a gap between the ends of the external conductor at the overlapping portion.

Figure 7:
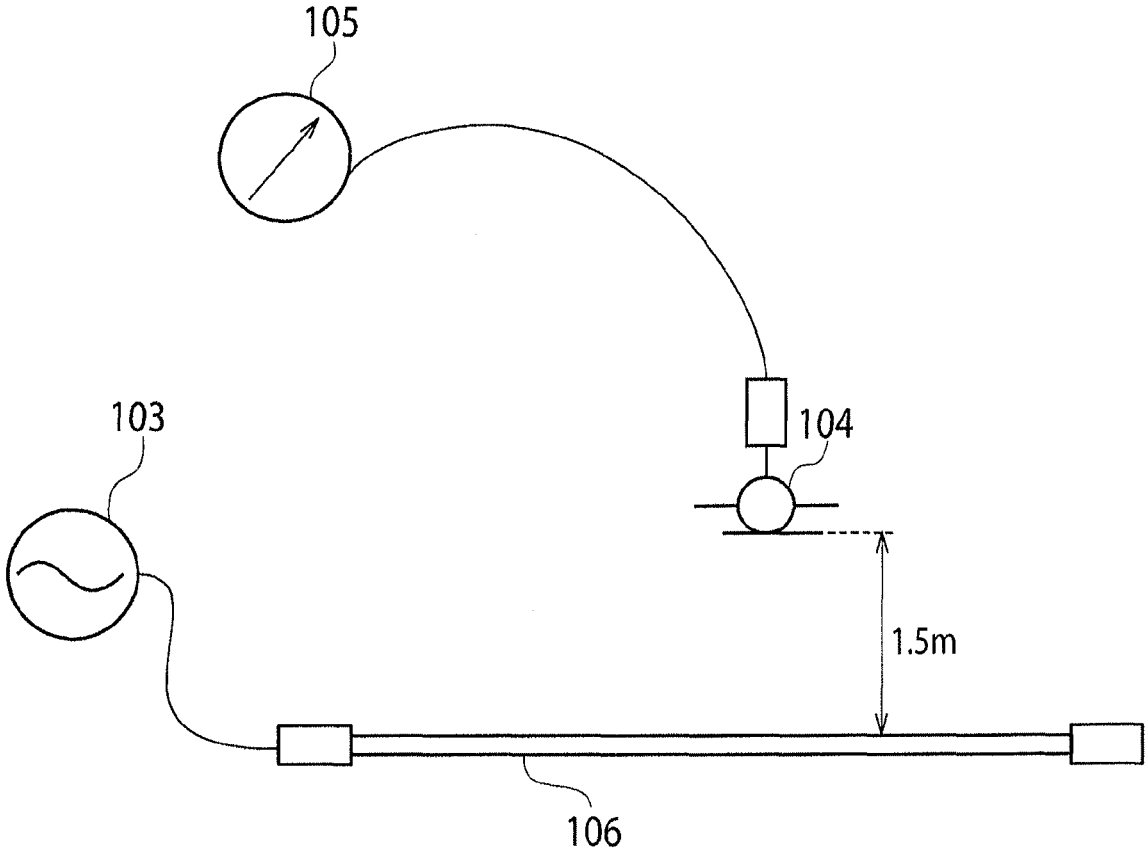
FIG. 7 is a schematic diagram showing a method of measuring the leakage of electromagnetic waves.

FIG. 7 is a schematic diagram showing a method of measuring the degree of unwanted leakage of electromagnetic waves.

As shown in this drawing, a cable 106 was connected to a signal generator 103, an antenna 104 was connected to a receiver 105, and the antenna 104 was installed at a predetermined distance (such as 1.5 m) away from the cable 106. A shield effect of the cable 106 was evaluated by measuring electromagnetic waves originating from the cable 106.

First, a coaxial cable was used as the cable 106. This coaxial cable had a central conductor, an insulator, an external conductor, a plastic film and an outer sheath with the same structures as those of the LCX of the present embodiment, but it did not include any slots. Specifically, opposed ends of the external conductor were in contact with each other at an overlapping portion of this coaxial cable. When the above-described cable was used, received power showed a value of −150 dBm which was equivalent to a measurement limit, whereas the received power was equal to 0 dBm when the signal generator 103 and the receiver 105 were directly connected together.

Next, measurement was conducted by using a leaky coaxial cable as the cable 106. This leaky coaxial cable had a central conductor, an insulator, an external conductor, a plastic film and an outer sheath with the same structures as the present embodiment except for interposing a plastic plate between the ends of the external conductor at the overlapping portion. The plastic plate had the thickness of 20 μm. Here, received power was equal to −130 dB.

Next, measurement was carried out by using the coaxial cable of the present embodiment. Here, received power was equal to −150 dBm. Accordingly, owing to the contact between the ends of the external conductor at the overlapping portion, unwanted leakage of electromagnetic waves was reduced by approximately 20 dB as compared to the conventional leaky coaxial cable. Thus, it was found that the leaky coaxial cable of the present embodiment had at least an equivalent shield effect as compared to that of the conventional coaxial cable.

Second Embodiment

Figure 8:
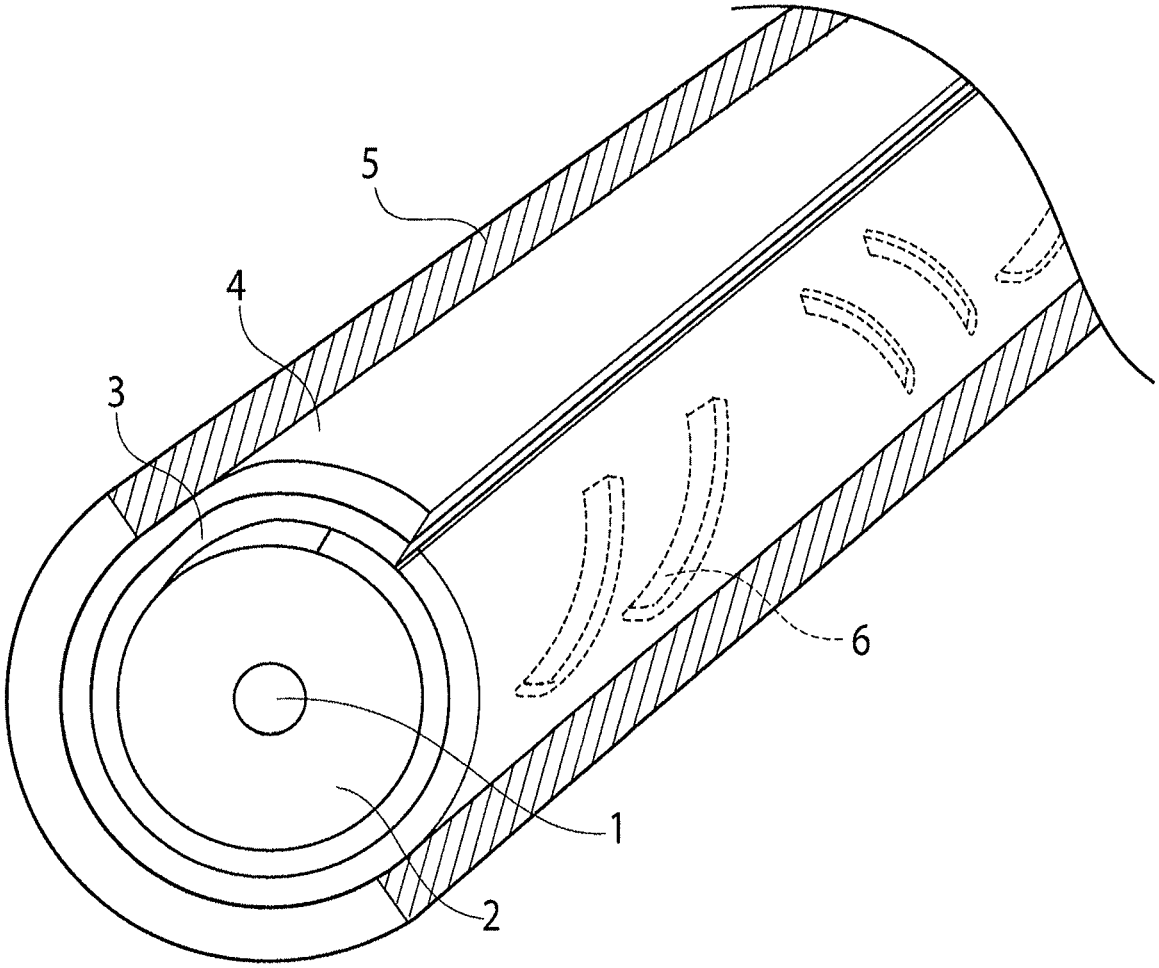
FIG. 8 is a cross-sectional view showing a configuration of a leaky coaxial cable of a second embodiment of the present invention.

FIG. 8 is a cross-sectional view showing a configuration of a leaky coaxial cable of a second embodiment of the present invention.

In the present embodiment, the width of the external conductor (i.e., its length in the perpendicular direction to the longitudinal direction before being wound around the insulator 2) is longer by 2 mm to 10 mm than the outer peripheral length of the insulator 2. In addition, this width is longer by 2 mm to 10 mm than the width of the plastic film 4. In this case, the external conductor 3 includes a portion protruding from the plastic film 4 at the beginning of being wound around the insulator 2, which is attributed to a surplus portion (an extra width portion) with respect to the plastic film 4. Accordingly, at an overlapping portion generated in the course of winding the external conductor 3, an end portion of the external conductor 3 located close to the insulator 2 and its adjacent portion come into direct contact with an end of the external conductor 3 close to the outer sheath 5 (the plastic film 4), and establish electrical connection.

As a consequence, unwanted leakage of electromagnetic waves from the overlapping portion of the external conductor 3 is prevented, and the original state of electromagnetic wave radiation is not disturbed. Moreover, it is possible to suppress attenuation which would otherwise be attributable to the unwanted leakage of electromagnetic waves.

The leaky coaxial cable of the present embodiment was subjected to the same evaluation as was that of the first embodiment in order to examine the degree of unwanted leakage of electromagnetic waves described above. Specifically, the shield effect between the coaxial cable connected to the signal generator 103 and the antenna 104 connected to the receiver 105 was evaluated. As a result of the evaluation using the coaxial cable of the present embodiment, received power was equal to −150 dB. Accordingly, like in the first embodiment, unwanted leakage of electromagnetic waves was reduced by approximately 20 dB as compared to the conventional leaky coaxial cable. Thus, it was found that there was at least an equivalent shield effect as compared to that of the conventional coaxial cable.

What is claimed is:

1. A leaky coaxial cable comprising:
a central conductor;
an insulator covering the central conductor;
an external conductor wound around the insulator, having a thickness of 5 μm to 44 μm, and including a plurality of slots formed periodically in a longitudinal direction of the cable;
a plastic film attached to the external conductor and having a thickness of 5 μm to 36 μm; and
an outer sheath covering the external conductor and the plastic film,
wherein the plastic film is attached to a surface of the external conductor facing the outer sheath,
the external conductor has a width that forms an overlapping portion in which ends of the external conductor overlap and contact with each other when the external conductor is wound around the insulator,
the width of the external conductor is longer by 2 mm to 10 mm than an outer peripheral length of the insulator, and
edges of the slots bite a surface of the insulator.

2. The leaky coaxial cable according to claim 1, wherein
the plastic film is attached to the external conductor by use of a first adhesive having viscosity and adhesiveness.

3. The leaky coaxial cable according to claim 2, wherein the plastic film directly sticks to the insulator by means of the first adhesive through the slots.

4. The leaky coaxial cable according to claim 1, wherein the plastic film is attached to the outer sheath by use of a second adhesive.

5. The leaky coaxial cable according to claim 1, wherein
the end of the external conductor in the overlapping portion, which is located closer to the insulator, protrudes from the plastic film.

6. The leaky coaxial cable according to claim 1, wherein the slots are formed at the same time by an etching method.

7. The leaky coaxial cable according to claim 1, wherein only one of the ends of the external conductor and one of the ends of the plastic film in the overlapping portion, which are located closer to the insulator, are bent outward.

8. A leaky coaxial cable comprising;
a central conductor;
an insulator covering the central conductor;
an external conductor wound around he insulator, having a thickness of 5 μm to 44 μm, and including a plurality of slots formed periodically in a longitudinal direction of the cable;
a plastic film attached to the external conductor by use of a first adhesive having viscosity and adhesiveness, and having a thickness of 5 μm to 36 μm; and
an outer sheath covering the external conductor and the plastic film,
wherein the plastic film is attached to a surface of the external conductor facing the outer sheath,
the external conductor has a width that forms an overlapping portion in which ends of the external conductor overlap and contact with each other when the external conductor is wound around the insulator,
the width of the external conductor is longer by 2 mm to 10 mm that an outer peripheral length of the insulator, and
the plastic film directly sticks to the insulator by means of the first adhesive through the slots.

9. The leaky coaxial cable according to claim 8, wherein edges of the slots bite a surface of the insulator.

10. The leaky coaxial cable according to claim 8, wherein the plastic film is attached to the outer sheath by use of a second adhesive.

11. The leaky coaxial cable according to claim 8, wherein only one of the ends of the external conductor and one of the ends of the plastic film in the overlapping portion, which are located closer to the insulator, are bent outward.

12. The leaky coaxial cable according to claim 8, wherein the end of the external conductor in the overlapping portion, which is located closer to the insulator, protrudes from the plastic film.

13. The leaky coaxial cable according to claim 8, wherein the slots are formed at the same time by an etching method.

* * * * *